US006345416B1

(12) United States Patent
Vollmar

(10) Patent No.: US 6,345,416 B1
(45) Date of Patent: Feb. 12, 2002

(54) DETACHABLE, AUXILIARY CAR DOOR HANDLE

(76) Inventor: Kathleen M. Vollmar, 1971 Orange Ave. E., St. Paul, MN (US) 55119

( * ) Notice: Subject to any disclaimer, the term of this patent is extended or adjusted under 35 U.S.C. 154(b) by 0 days.

(21) Appl. No.: 09/464,103

(22) Filed: Dec. 16, 1999

(51) Int. Cl.[7] ..... A45C 13/22; E05B 1/00

(52) U.S. Cl. ..... 16/413; 16/443; 16/422; 16/426; 16/428; 16/24; 16/302

(58) Field of Search ..... 16/413, 426, 428, 16/DIG. 15, DIG. 25; 24/302, 301; 294/170, 137, 31.2, 16, 82.13; 296/207, 146.1, 146.9, 128, 152; 49/139, 140

(56) References Cited

U.S. PATENT DOCUMENTS 1,472,997 A * 11/1923 Stevenson ..... 16/DIG. 15
1,540,155 A * 6/1925 Wydom et al. ..... 16/DIG. 15
1,571,494 A * 2/1926 Scott et al. ..... 24/302
2,586,262 A * 2/1952 Robins ..... 24/302
4,003,227 A 1/1977 Casey
4,168,011 A 9/1979 Lomer
4,451,956 A * 6/1984 Kawahara ..... 24/302
4,832,391 A * 5/1989 Moell ..... 294/82.13
D344,665 S 3/1994 Baker
D344,666 S 3/1994 Breitrick
5,437,484 A 8/1995 Yamada
5,676,178 A * 10/1997 Ehnimb ..... 24/302
5,809,620 A * 9/1998 Crowley et al. ..... 24/302

* cited by examiner

*Primary Examiner*—Chuck Y. Mah

(57) ABSTRACT

A detachable, auxiliary car door handle comprises an intermediate grip (16) and end clips (18) adapted for selective attachment to the edge of a door to facilitate opening.

6 Claims, 2 Drawing Sheets

DETACHABLE, AUXILIARY CAR DOOR HANDLE

TECHNICAL FIELD

The present invention relates generally to manual hand tools and handles. More particularly, this invention pertains to a new and unique detachable door handle to facilitate opening stuck doors of cars, trucks or other vehicles.

BACKGROUND ART

Cars, trucks and other vehicles typically include doors for ingress and egress of the driver and any passengers. Such doors usually include, on both the inside and outside, handles for opening and closing as well as locks for latching the doors when closed. The handles and locks take various forms, and sometimes their functions are integrated. Rubber seals or gaskets are generally provided about the periphery, which also act to cushion the doors when they are closed. Such doors are designed to function over numerous operational cycles, and are generally quite reliable.

However, circumstances can arise when such doors cannot readily be opened even when unlocked. For example, during the winter, such doors can become frozen about their peripheries and stuck closed, such as under some conditions of low temperature and high humidity. This can occur after operating the car with warm and humid interior air and then parking it overnight in low temperatures, after which the doors can be quite difficult to open.

Various approaches to this problem have been employed with mixed success Of course, frozen doors can sometimes be yanked open. Forcing a door open by means of its handle can damage or even break the handle. Hot water can be used, but this often makes the problem worse, especially if the outside temperature is very cold. Electric hairdryers are inconvenient and time-consuming. Prying the door open with some kind of garage tool can damage the door and/or the car body.

For example, U.S. Pat. No. Des. 344,665 to Baker shows a tool for prying open frozen automobile doors.

A need has thus arisen for a new and unique detachable car door handle for opening stuck doors of cars, trucks or other vehicles.

SUMMARY OF INVENTION

The present invention comprises a detachable, auxiliary car door handle that overcomes the foregoing and other difficulties associated with the prior art. In accordance with the invention there is provided an improved hand tool that functions as an auxiliary handle for selective attachment to a car door in two places to minimize or avoid any damage. The detachable handle herein is adapted to be placed on a car door before it is closed and left in place when the car is parked for use later if the door becomes stuck.

BRIEF DESCRIPTION OF DRAWING

A better understanding of the invention can be had by reference to the following Detailed Description in conjunction with the accompanying Drawing, wherein.

DETAILED DESCRIPTION

Figure 1:
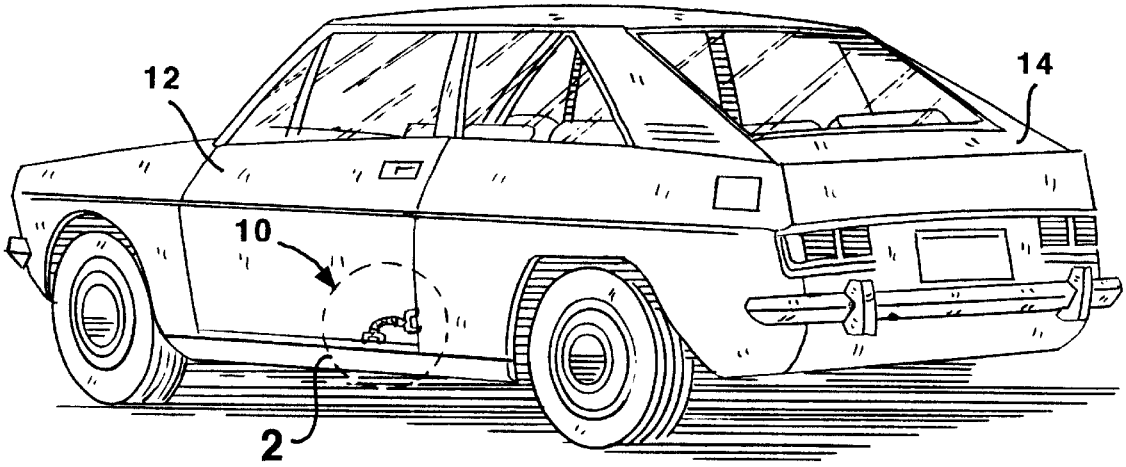
FIG. 1 is an illustration of an automobile with a detachable, auxiliary car door handle incorporating the invention.
Figure 2:
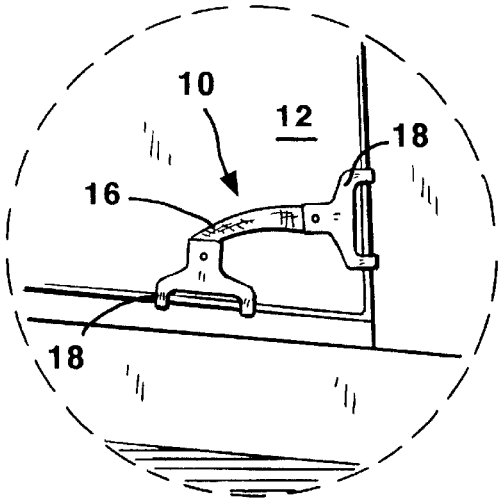
FIG. 2 is an enlargement of a portion of FIG. 1.
Figure 3:
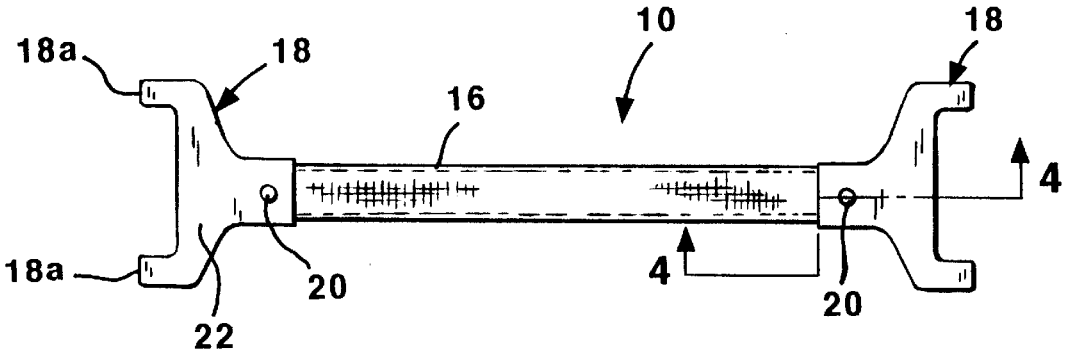
FIG. 3 is a plan view of the detachable, auxiliary car door handle herein.
Figure 4:
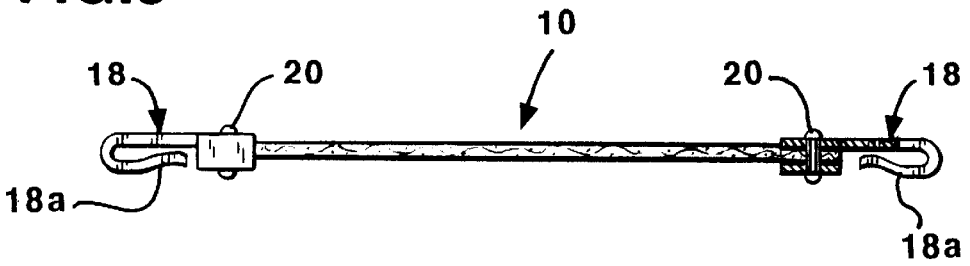
FIG. 4 is a side elevational view thereof.

Referring now to the Drawing, wherein like reference numerals designate like or corresponding elements throughout the views, and particularly referring to FIGS. 1 through 4, there is shown the detachable, auxiliary car door handle 10 of the present invention. FIGS. 1 and 2 show the handle 10 as it would typically be placed; on the lower right corner of the door 12 of a vehicle 14 such as an automobile, truck or the like. As will be explained more fully hereinafter, the handle 10 incorporates various features substantially enhancing operation and use.

The handle 10 comprises an intermediate grip 16 with a clips 18 secured to at least one end, and preferably both ends thereof as shown. Grip 16 is preferably formed from suitable flexible and inextensible material, such as a strap of nylon or polyester webbing of suitable length. For example, grip 16 can be about-four to six inches long.

The clips 18 are secured to grip 16 by fasteners 20. In the preferred embodiment, rivets are used, although Any suitable fasteners can be used.

Each clip 18 is adapted to fit snugly about and snap onto the edge of the car door 12 as shown. The clips 18 are formed from suitable rigid material, such as metal or plastic. In the preferred embodiment, the clips 18 are formed from metal with a rubberized or plasticized coating 22 to avoid scratching the finish of door 12, with the clips being of a C-shaped configuration to provide two spaced-apart clipping portions 18*a* at each end, as shown.

Figure 5:
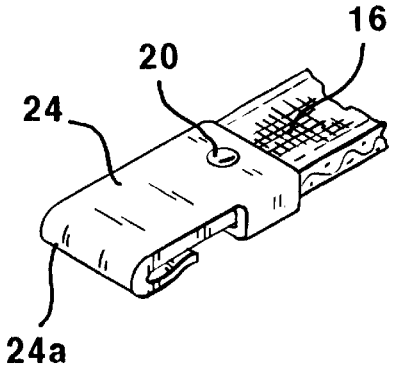
FIG. 5 is a perspective view of an alternate end construction.

FIG. 5 shows an alternate form of clip 24 with only one clipping portion 24*a*, which could also be used if desired.

Figure 6:
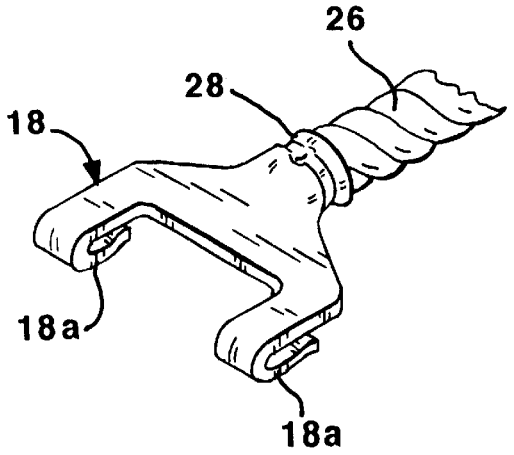
FIG. 6 is a perspective view of an alternate grip construction.

FIG. 6 shows an alternate grip 26 in the form of wound cable or rope secured by a clamp collar 28 to clip 18, which could also be used if desired.

From the foregoing, it will be appreciated that the present invention comprises a detachable, auxiliary car door handle having.,several advantages over the prior art. The handle herein does not rely on a prying action with high localized forces that could cause damage, but rather relies on gripping the periphery of the door over two spaced-apart areas. The handle herein can be clipped to the door and left in place, and when not in use can be rolled up and stowed in a compact space, such as the glove compartment. The handle herein is of relatively of simple, inexpensive construction. Other advantages will be evident to those skilled in the art.

Although particular embodiments of the invention have been illustrated in the accompanying Drawing and described in the foregoing Detailed Description, it will be understood that the invention is not limited only to the embodiments disclosed, but is intended to embrace any equivalents, modifications and/or rearrangements of elements falling within the scope of the invention as defined by the following claims.

What is claimed is:

1. In combination with a car door, a detachable, auxiliary handle, comprising:

an elongate longitudinal grip of predetermined length having opposite ends, said grip being formed from a flexible but substantially inextensible material;

a pair of clips; and means for securing one clip to each of said grip, each clip being formed from relatively rigid material and being in a releasable snug engagement about an edge of the car door.

2. The detachable, auxiliary car door handle of claim 1, wherein said grip comprises a strap formed of synthetic webbing material selected from the group consisting of polyester and nylon.

3. The detachable, auxiliary car door handle of claim 1, wherein each clip includes a pair of spaced-apart, separate gripping portions.

4. In combination with a car door, a detachable, auxiliary handle, comprising:

an elongate longitudinal grip of predetermined length having opposite ends;

said grip comprising a strap formed from a flexible but substantially inextensible length of synthetic webbing material selected from the group consisting of nylon and polyester;

a pair of rigid clips, each having opposite ends, one end of each clip being in a releasable snug engagement about the edge of the car door; and means for affixing the other ends of said clips to the ends of said grip.

5. The detachable auxiliary car door handle of claim 4, wherein each clip is formed of metal with a plasticized coating.

6. The detachable, auxiliary car door handle of claim 5, wherein each clip includes a pair of spaced-apart separate clipping portions.

* * * * *